US009452347B2

(12) United States Patent
Madding et al.

(10) Patent No.: US 9,452,347 B2
(45) Date of Patent: Sep. 27, 2016

(54) DEVICE TO SECURE THE MOUTH OF A PLAYING CARD SHOE

(75) Inventors: Scott Madding, Middletown, OH (US); Suzanne Bilyeu, Mason, OH (US); Dylan Horvath, Toronto (CA)

(73) Assignee: The United States Playing Card Company, Erlanger, KY (US)

( * ) Notice: Subject to any disclaimer, the term of this patent is extended or adjusted under 35 U.S.C. 154(b) by 0 days.

(21) Appl. No.: 14/116,615

(22) PCT Filed: Jun. 1, 2012

(86) PCT No.: PCT/US2012/040348
§ 371 (c)(1),
(2), (4) Date: Nov. 8, 2013

(87) PCT Pub. No.: WO2012/167004
PCT Pub. Date: Dec. 6, 2012

(65) Prior Publication Data

US 2014/0091523 A1 Apr. 3, 2014

Related U.S. Application Data

(60) Provisional application No. 61/492,842, filed on Jun. 3, 2011.

(51) Int. Cl.
*A63F 1/14* (2006.01)
*A63F 1/10* (2006.01)

(52) U.S. Cl.
CPC . *A63F 1/10* (2013.01); *A63F 1/14* (2013.01); *A63F 2250/245* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 4,023,705 A * 5/1977 Reiner et al. ..... 221/186
4,377,285 A * 3/1983 Kadlic ..... 273/148 A
4,711,371 A * 12/1987 Harrigan ..... A63F 1/14 211/51
4,750,743 A * 6/1988 Nicoletti ..... 273/148 A
5,114,153 A * 5/1992 Rosenwinkel et al. ..... 273/292
5,356,145 A * 10/1994 Verschoor ..... 273/149 R
5,374,061 A 12/1994 Albrecht
5,382,024 A * 1/1995 Blaha ..... 273/149 R
5,584,483 A * 12/1996 Sines et al. ..... 273/149 R
5,590,896 A * 1/1997 Eichhorn ..... 280/642
5,941,769 A * 8/1999 Order ..... 463/12

(Continued)

*Primary Examiner* — Michael Dennis
*Assistant Examiner* — Dolores Collins
(74) *Attorney, Agent, or Firm* — Seth M. Blum

(57) ABSTRACT

The present disclosure is directed to a security apparatus for use on a playing card shoe to prevent the removal of playing cards from the splaying card shoe. Playing card shoes generally have an elongated body including a card cradle for supporting a plurality of playing cards, The card cradle has an outlet opening adjacent to a front end of the elongated body, through which playing cards can be removed from the playing card shoe, A cradle cover is removably attached to the elongated, body, covering the card cradle and playing cards therein. A faceplate is removably attach to the outer front, end of the elongated body, and defines a mouth through which playing cards can be drawn from the outlet opening. The security apparatus prevents the removal a playing cards from the shoe, where the security apparatus is removably attached to the playing card shoe to block and/or cover the outlet opening.

7 Claims, 8 Drawing Sheets

(56) References Cited

U.S. PATENT DOCUMENTS

| | | | | |
|---|---|---|---|---|
| 6,582,301 | B2 * | 6/2003 | Hill | A63F 1/14 273/149 R |
| 6,637,622 | B1 * | 10/2003 | Robinson | A63F 1/14 221/232 |
| 7,575,235 | B2 * | 8/2009 | Belill | 273/292 |
| 7,593,544 | B2 * | 9/2009 | Downs, III | A63F 1/14 273/148 A |
| 7,699,694 | B2 * | 4/2010 | Hill | 463/11 |
| 7,762,889 | B2 * | 7/2010 | Shigeta | 463/29 |
| 7,866,667 | B2 * | 1/2011 | Fruchtman | 273/148 A |
| 7,946,486 | B2 * | 5/2011 | Nakamura | 235/385 |
| 7,946,586 | B2 * | 5/2011 | Krenn | A63F 1/14 273/149 R |
| 8,170,323 | B2 * | 5/2012 | Downs, III | 273/148 A |
| 8,221,244 | B2 * | 7/2012 | French | 463/43 |
| 8,342,525 | B2 * | 1/2013 | Scheper et al. | 273/149 R |
| 8,544,847 | B2 * | 10/2013 | Emori | 273/149 R |
| 8,590,896 | B2 * | 11/2013 | Krenn et al. | 273/149 R |
| 8,636,205 | B2 * | 1/2014 | Hammad et al. | 235/379 |
| 8,636,285 | B2 * | 1/2014 | Grauzer et al. | 273/149 R |
| 8,727,350 | B2 * | 5/2014 | Flynn | A63F 1/14 273/149 R |
| 2005/0093231 | A1 * | 5/2005 | Grauzer et al. | 273/149 R |
| 2006/0279040 | A1 * | 12/2006 | Downs et al. | 273/149 R |
| 2007/0216092 | A1 * | 9/2007 | Fleckenstein | 273/149 R |
| 2007/0290438 | A1 | 12/2007 | Grauzer | |
| 2008/0303210 | A1 | 12/2008 | Grauzer | |
| 2009/0066021 | A1 | 3/2009 | Shigeta | |
| 2009/0121429 | A1 * | 5/2009 | Walsh | A63F 1/14 273/149 R |
| 2009/0134575 | A1 | 5/2009 | Dickinson | |
| 2009/0224476 | A1 | 9/2009 | Grauzer | |
| 2009/0267297 | A1 | 10/2009 | Blaha | |
| 2010/0216531 | A1 | 8/2010 | Just | |

* cited by examiner

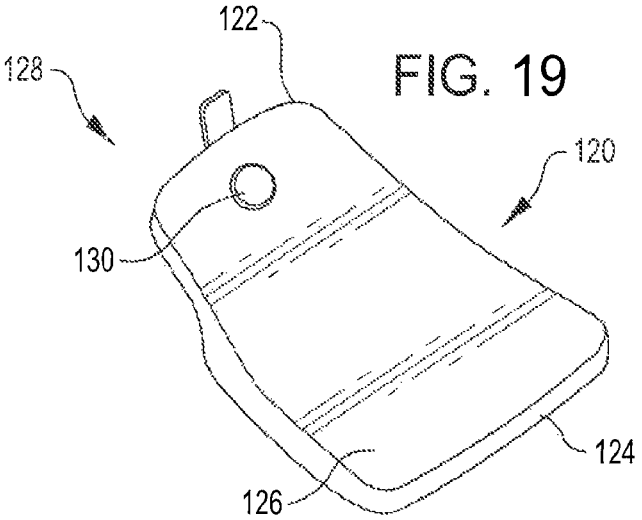
FIG. 19
FIG. 20
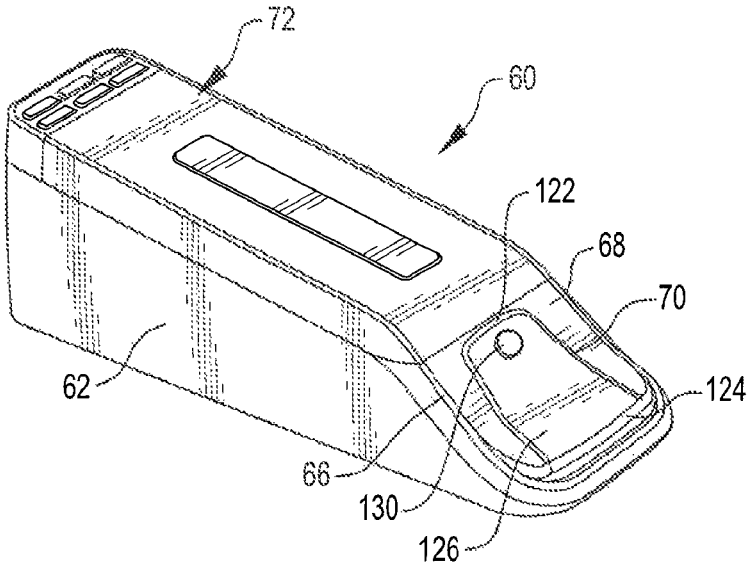

DEVICE TO SECURE THE MOUTH OF A PLAYING CARD SHOE

FIELD OF THE INVENTION

The invention relates to playing card shoes, and more particularly to a device for preventing the removal of playing cards from the mouth of a playing card shoe.

BACKGROUND OF THE INVENTION

Card games in casinos are very profitable, but also prone to fraud by players and casino staff. This fraudulent activity is a source of significant loss in revenue to the casinos. In casino card games the cards are dealt to the players from a card shoe. In order to prevent and/or mitigate these losses, casinos continue to identify and implement security features and enhancements A card shoe includes a card cradle and a card removal portion, mouth. A lockable cover is removably positionable over the card cradle, preventing unauthorized access to the cards. However, the mouth of the shoe remains open, permitting access to the cards when the shoe is unattended.

SUMMARY OF THE INVENTION

The present disclosure is directed to a security apparatus for use on a playing card shoe to prevent the removal of playing cards from the playing card shoe. Playing cards shoes generally have an elongated body including a card cradle for supporting a plurality of playing cards. The card cradle has an outlet opening adjacent to a front end of the elongated body through which playing cards can, be removed from the playing card shoe. A cradle cover is removably attached to the elongated body, covering the card cradle and playing cards therein. A faceplate can be removably attached to the outer front end of the elongated body, and defines a mouth through which playing cards can be drawn from the outlet opening.

The security apparatus is direct towards a device for preventing the removal of playing cards though the outlet opening at the front of the playing cards shoe. To accomplish this, a security apparatus is removably attached to the playing card shoe to block and/or cover the outlet opening.

Such an apparatus can include a card shield having a first end and a second end, where the card shield is positionable in the card cradle of the playing card shoe. The first end of the card shield is positioned between the playing cards and the outlet opening, with at least a portion of the first end extending through the outlet opening. In this manner, the cards shield blocks the outlet opening.

The security apparatus can further include a retaining member affixed to an underside portion of the cradle cover. When installed the retaining member engages at least a portion of the card shield. A cut card is further provided, and is positionable between the playing cards and the outlet opening, where the first end of the card shield is positioned between the cut card and the outlet opening. When installed, the security apparatus prevent the removal of playing cards from the outlet opening. Furthermore, the card shield is secured in the playing card shoe such that it cannot be pushed into or pulled out of the playing card shoe.

Alternatively, the security apparatus can include a front cover which is positionable on the outer front end of the playing card shoe. The front cover has a solid outer surface, which when installed covers the outlet opening of the playing card shoe. The front cover can further include a locking mechanism to secure the front cover to the body.

To install the front cover the faceplate must first be removed. After which, the front cover can be snap fitted onto the front end on the playing cards shoe. To place the playing card shoe in a game ready condition, the front cover is removed and the faceplate is reinstalled.

Alternatively, the security apparatus can include a faceplate insert which is positionable into the mouth of the faceplate. The faceplate insert has a solid outer surface, which when installed covers the outlet opening of the playing card shoe. The faceplate insert can further include a locking mechanism to secure the front cover to the body. To place the playing card shoe in a game ready condition, the faceplate insert is removed.

BRIEF DESCRIPTION OF THE DRAWINGS

A more complete understanding of the present invention, and the attendant advantages and features thereof; will be more readily understood by reference to the following detailed description when considered in conjunction with the accompanying drawings wherein.

Figure 1:
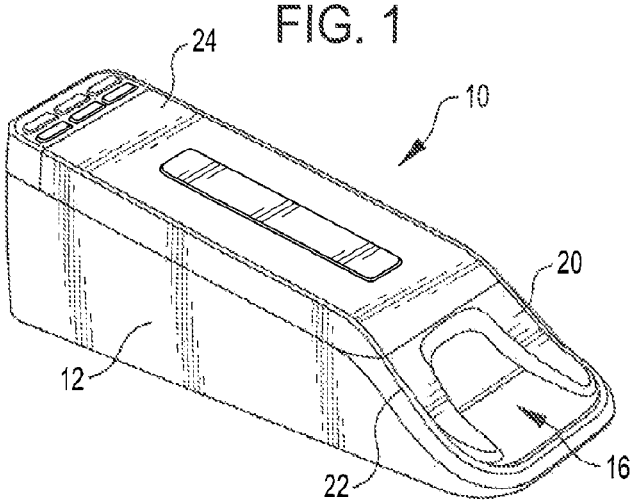
FIG. 1 depicts an exemplary card shoe of the present disclosure.
Figure 4:
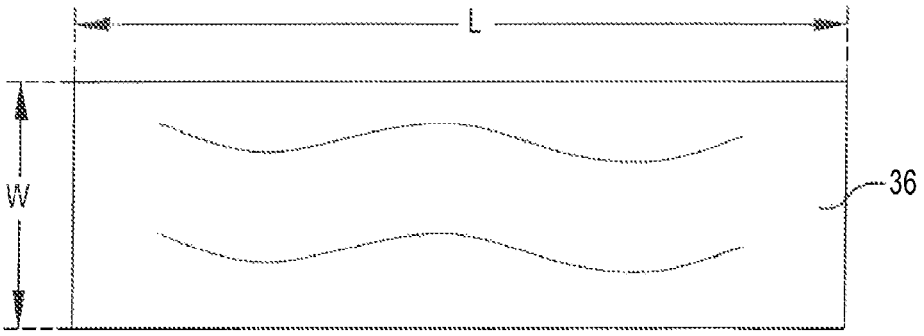
Figure 5:
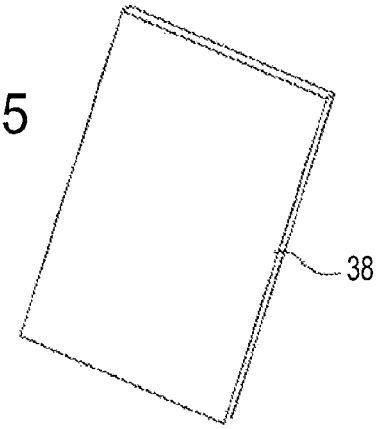
Figure 6:
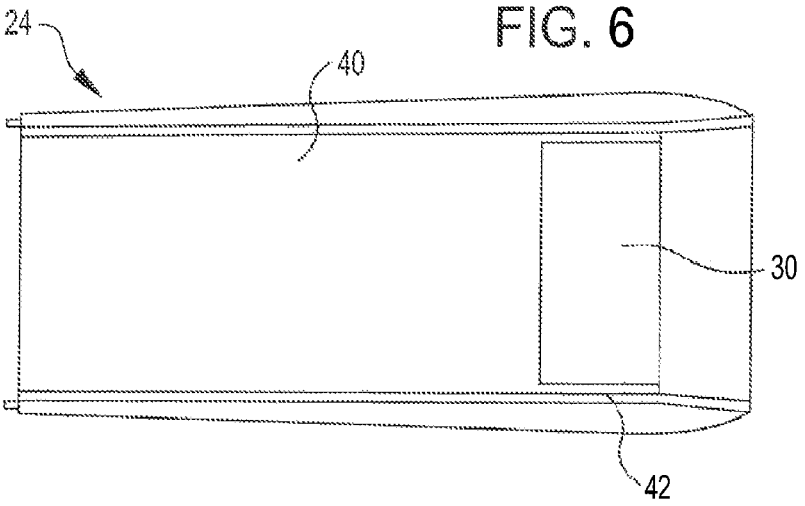
Figure 7:
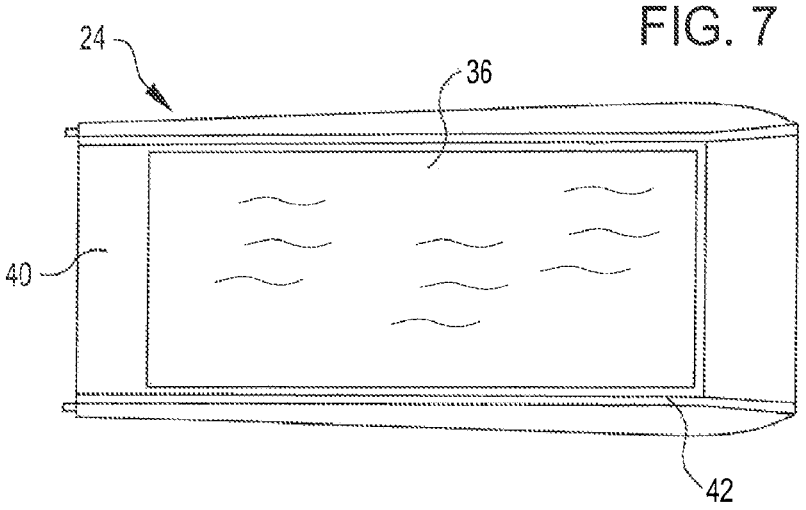
Figure 8:
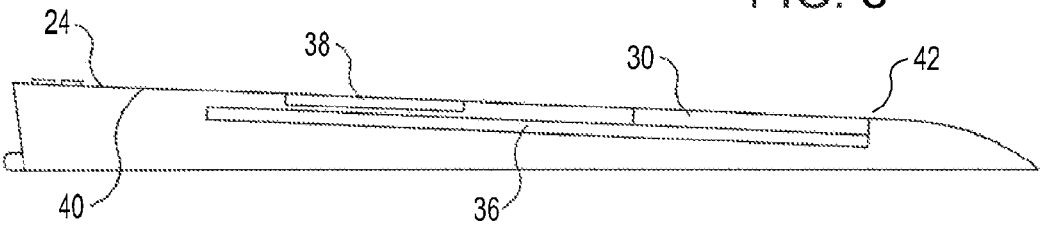
Figure 9:
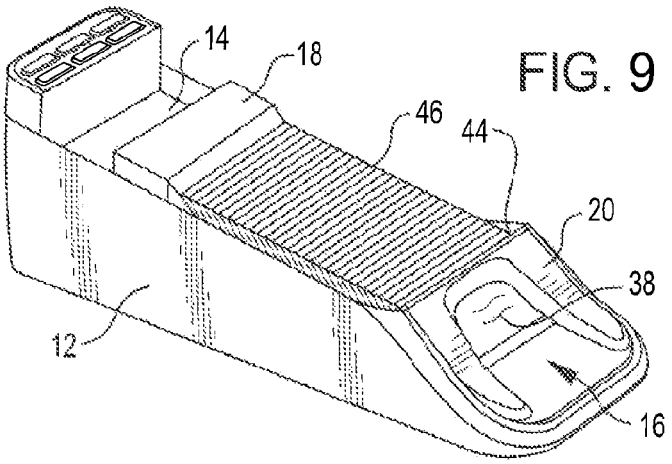
Figure 10:
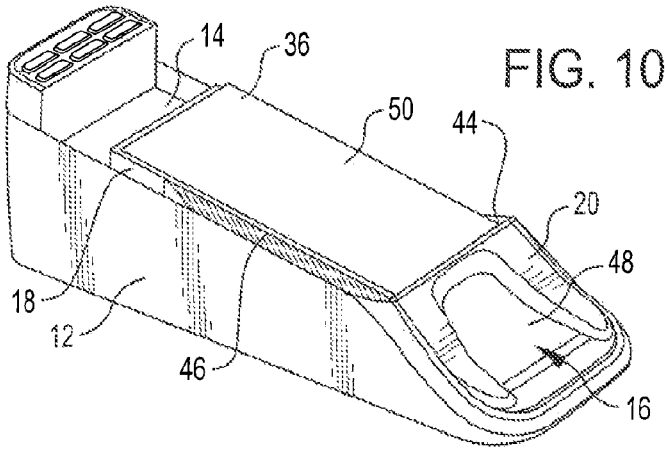

FIG, 3 depicts a retaining magnet of the present invention;

FIG. 4 depicts a card shield of the present invention;

FIG. 5 depicts a cut card of the present invention;

FIG. 6 depicts a bottom view of the shoe cover including the retaining magnet;

FIG. 7 depicts a bottom view of the shoe cover including the card shield;

FIG. 8 depicts a side sectional view of the shoe cover;

FIG. 9 depicts the position of the cut card in the card shoe of FIG. 1;

FIG. 10 depicts the position on the card shield in the card shoe of FIG. 1

Figure 11:
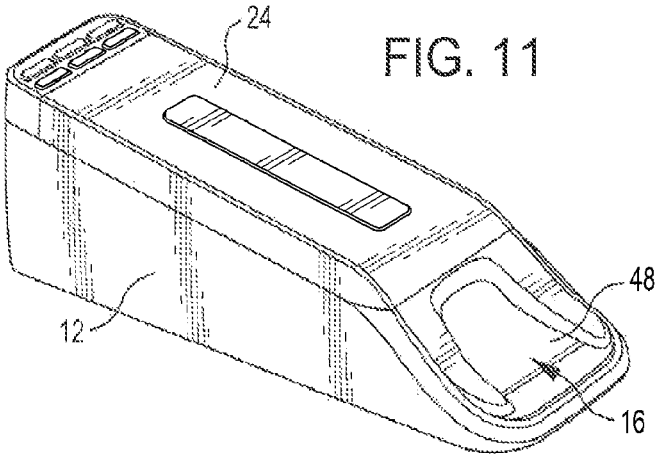
Figure 12:
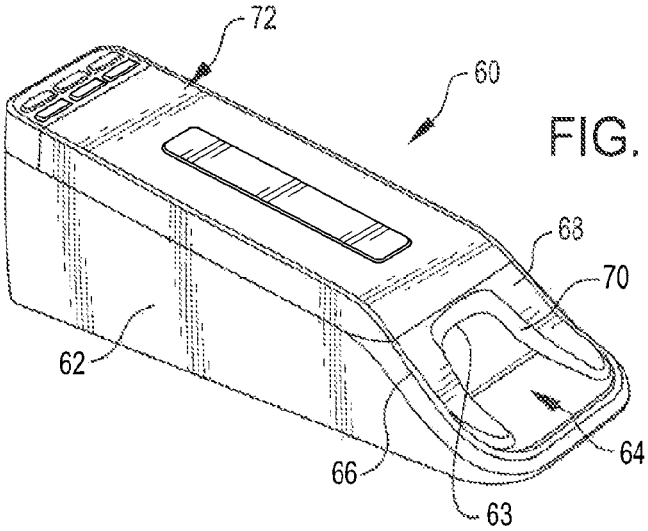
Figure 13:
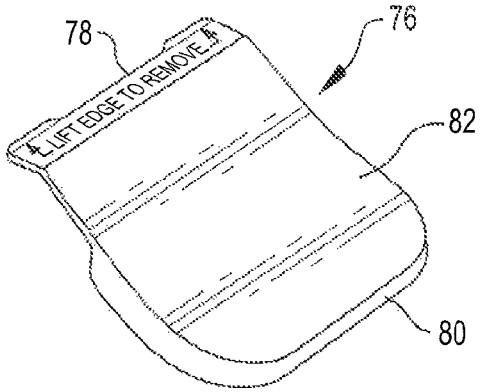
Figure 14:
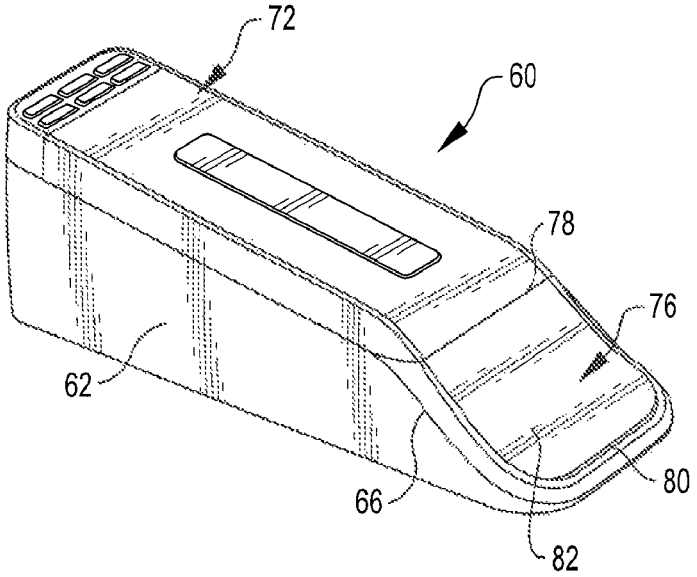
Figure 15:
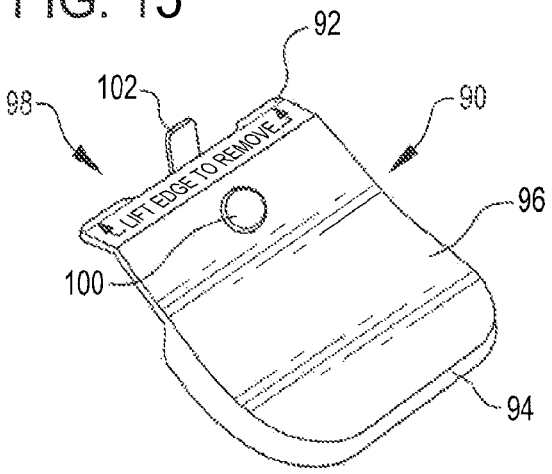
Figure 16:
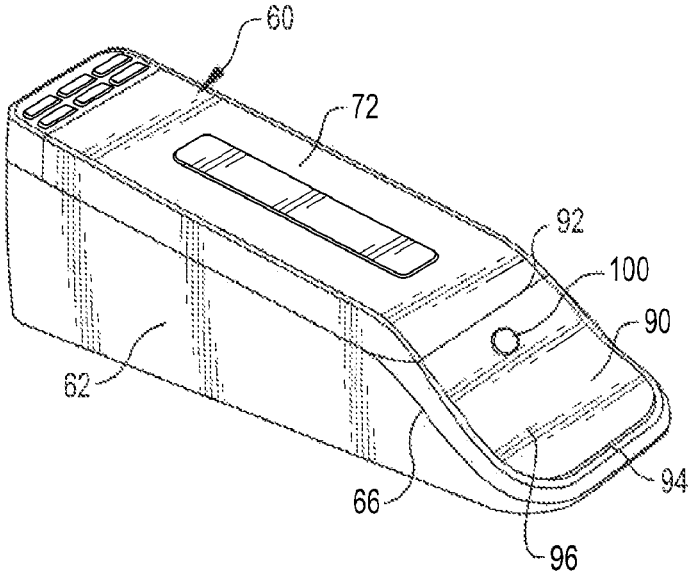
Figure 17:
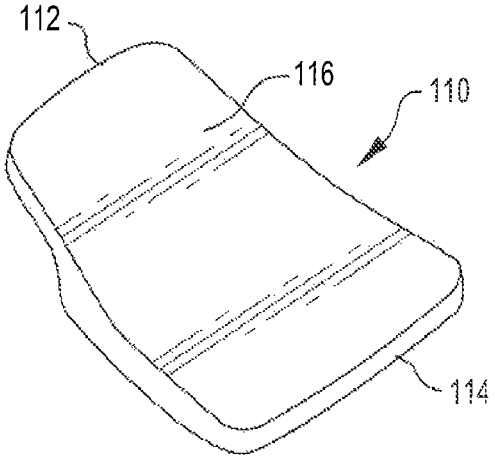
Figure 18:
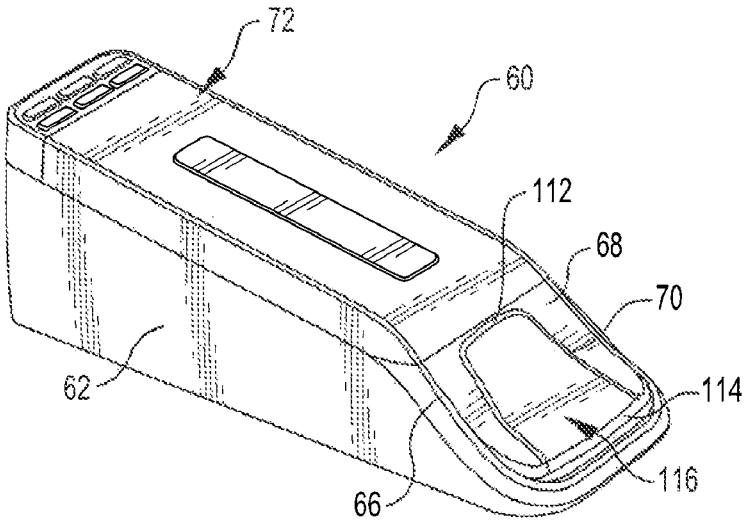

FIG. 11 depicts the card shoe of FIG. 1 in a protected condition;

FIG. 12 depicts another exemplary card shoe of the present disclosure;

FIG. 13 depicts a front cover of the present invention;

FIG. 14 depicts the front cover of FIG. 13 positioned on the card shoe of FIG. 12;

FIG. 15 depicts a alternative front cover of the present invention;

FIG. 16 depicts the front cover of FIG. 13 positioned on the card shoe of FIG. 12;

FIG. 17 depicts a faceplate insert of the present invention;

FIG. 18 depicts the faceplate insert of FIG. 17 positioned on the card shoe of FIG. 12;

FIG. 19 depicts an alternative faceplate insert of the present invention; and FIG, 20 depicts the faceplate insert of FIG. 19 positioned on the card shoe of FIG. 12.

DETAILED DESCRIPTION OF THE INVENTION

The present disclosure is directed to a card shoe security system for use in the gaming industry. The subject security system protects the mouth of a card Shoe, preventing the removal of playing cards therefrom.

Figure 2:
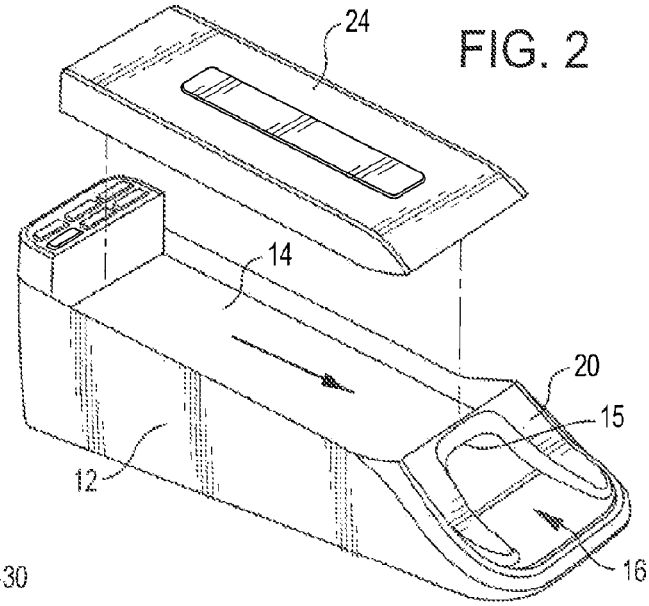
FIG. 2 depicts the card shoe of FIG, 1 with the shoe cover removed.

Referring now to the drawing figures in Which like reference designators refer to like elements, there is shown in FIGS. 1 and 2, an exemplary card shoe 10. The card shoe 10 generally includes a body portion 12 having a card cradle 14 sized to fit a plurality of decks of playing cards. The card cradle 14 is provided at an angle, such that playing cards slide towards the front of the card cradle 14, being removable though an outlet opening 15 in the card shoe 10. A weighted mouse 18 can be positioned within the card cradle 14, behind the playing cards, to force the playing cards towards the front of the card cradle 14 (see FIG. 9). A faceplate 20 is positioned on the front surface 22 of the body 12 adjacent to the outlet opening 15, having a generally inverted V-shaped or U-shaped opening defining the mouth 16 though which the playing cards are drawn from the outlet opening 15 by a dealer. A shoe cover 24 is removably positionable on the body 12, covering the card cradle 14 and playing cards. The shoe cover 24 can be secured to the body 12 with a locking mechanism (not shown), preventing unwanted access to the playing cards within the card cradle 14.

Figure 3:
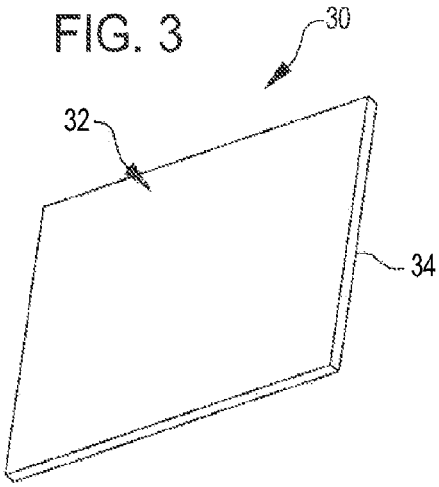

Referring to FIGS. 3-4, components of a card shoe protection system of the present disclosure are provided. The card shoe protection system includes a retaining magnet 30 having a first side 32 and a second side 34, where the second side 34 includes an adhesive material. The card shoe protection system further includes a card shield 36 and cut card 38. The card shield 36 had a length "L" and a width "W," where the length "L" and width "W" are selected to fit within the card cradle 14 of the card shoe 10. The card shield 36 can be sized to extend partially through the mouth 16 of the card shoe 18 and covering at least a portion of the playing cards within the card cradle 14. In an embodiment, the length "L" of the card shield 36 is about 8 inches and the width is about 3.5 inches. These dimensions are selected to fit the card shield 36 in the exemplary card shoe 10 provide herein. However, the dimensions of the card shield 36 can vary, depending on the dimensions of the cards shoe for use therein.

The card shield 36 can be made of a thin magnetic material, such that it can be retained by the retaining magnet 30. Alternatively, the card shield 36 can be made from non-magnetic material, such as plastic, having magnetic inserts therein. In this manner, the card shield 36 can be retained by the retaining magnet 30. The cut card 38 is the size of a playing card. While the disclosed retention of the card shield 36 utilizes a magnet, other retaining means are completed, include but not limited to the used on hook and loop fasteners on the cards shield 36 and in place of the retaining magnet 34.

Referring to the FIGS. 7-8, the card shoe protection system is stored in the cards shoe 10 as follows. The second side 34 of the retaining magnet 30 is affixed to an underside surface 40 of the shoe cover 24 with the adhesive material. The retaining magnet 30 being positioned proximal to a front end 42 of the shoe cover 24. The card shield 36 is placed on the underside surface 40 of the shoe cover 24, with the retaining magnet 40 contacting and retaining at least a portion of the card shield 36. The cut card 38 is interposed between the underside surface 40 of the shoe cover 24 and the card shield 36. In this configuration, the shoe cover 24 can be positioned on the card shoe body 12, allowing playing cards to be freely drawn from the mouth 16 of the card shoe 10.

Referring to FIGS. 9-10, to secure the card shoe 10, the shoe cover 24 is removed from the card shoe body 12. The cut card 38 and card shield 36 are removed for the underside surface 40 of the shoe cover 24. The cut card 38 is positioned between a front surface 44 of the card cradle 14 and the playing cards 46, with at least a portion of the cut card 38 extending into the mouth 16 of the card shoe 10. A first end 48 of the card shield 36 is positioned between the cut card 38 and the front surface 44 of the card cradle 16 of the card shoe 10. At least a portion of the card shield 36 is positioned in the mouth 16 of the card shoe 12, such that the mouth 16 of the card shoe 10 is blocked by a first end 48 of the card shield 36. The remaining portion 50 of the card shield 36 is positioned over of the playing cards 46. The shoe cover 24 is reinstalled on the card shoe body 12. In this configuration, the blocking of the mouth 16 by the first end 48 of the card shield 36 prevents the removal of playing cards 46 from the card shoe 10. Furthermore, the card shield 36 is secured within the card shoe 10 by the retaining magnet 30, not being able to be pushed back into the card shoe 10, or pulled out of the mouth 16 of the card shoe 10.

To configure the card shoe 10 for game play, the shoe cover 24 is removed from the body 12 of the card shoe 10. The card shield 36 is removed from the mouth 16 of the card shoe 10. The card shield 36 is placed on the underside surface 40 of the shoe cover 24, with the retaining magnet 40 retaining the card shield 36. The cut card 38 is removed from the card cradle 14, where the cut card 38 is then interposed between the underside surface 40 of the shoe cover 24 and the card shield 36. The shoe cover 24 is positioned back on the card shoe body 12, allowing playing cards 46 to be freely drawn from the mouth 16 of the card shoe 10.

Referring to FIG. 12 there is shown an exemplary card shoe 60. The card shoe 60 generally includes a body portion 62 having a card cradle (not shown) sized to fit a plurality of decks of playing cards. The card cradle is provided at an angle, such that playing cards slide towards the front of the card cradle, being removable though an outlet opening 63 located at the front of the card shoe 60. A faceplate 68 is positioned on the front surface 66 of the body 62, adjacent to the outlet opening 63. The faceplate 68 includes a generally inverted V-shaped or U-shaped opening 70 defining the mouth 64 though which a dealer draws playing cards form the outlet opening 63. A shoe cover 72 is removably positionably on the body 62, covering the card cradle and playing cards. The shoe cover 72 can be secured to the body 62 with a locking mechanism (not shown), preventing unwanted access to the playing cards within the card cradle.

Referring to FIG. 13, there provided a front cover plate 76. The front cover plate 76 includes first and second ends 78 and 80, and has a solid front surface 82. The front cover plate 76 is sized and configured to fit onto the front surface 66 of the card shoe body 62, replacing the faceplate 68.

Referring to FIG. 14, to secure the card shoe 60 the faceplate 68 is first removed from the front surface 66 of the card shoe body 62. The faceplate 68 is removably attached to the front surface 66 of the card shoe body 62 allowing for easy removal. For example, the faceplate 68 can be snap fitted onto the card shoe body 62 using an annular or cantilever snap it mechanism.

The front cover plate 76 is then positioned on and attached to the front surface 66 of the card shoe body 62, with the first end 78 being positioned adjacent of an upper portion of the front face 66 and the second end 80 being position to a lower portion of the front face 66. The front cover plate 76 is removably attached to front surface 66 of the card shoe body 62 allowing for easy installation and removal. For example, the faceplate 68 can be snap fitted onto the card shoe body 62 using an annular or cantilever snap fit mechanism. As the front cover plate 76 has a solid front surface 82 the front cover plate 76 prevents access to the play cards through the front surface 66 of the cards shoe body 62.

To configure the card shoe 60 for game play the front cover plate 76 is first removed. The face plate 68 is then positioned on and attached to the front surface 66 of the card shoe body 62. The reinstallation of the faceplate 68 on the card shoe body 62 allows playing cards to be freely drawn from the mouth 65 of the card shoe 60.

Referring to FIG. 15, there provided an alternative front cover plate 90. The front cover plate 90 includes first and second ends 92 and 94, and has a solid front surface 96. The front cover plate 90 is sized and configured to fit onto the front surface 66 of the card shoe body 62, replacing the faceplate 68. The front cover plate 90 further includes a locking mechanism 98 having a mechanical actuator 100 and a lever mill 102, where an activation of the actuator 100 will rotate the lever arm 102 from an unlocked position to a locked position, and a locked position to an unlocked position. In an example, the actuator 100 is depicted as a depression switch, the push of which will rotate the lever arm 102 from an unlocked position to a locked position, and a locked position to an unlocked position. However, other mechanical actuators 100 are contemplated, including key systems, rotatable actuators and the like.

Referring to FIG. 16, to secure the card shoe 60 the faceplate 68 is first removed from the front surface 66 of the card shoe body 62. The faceplate 68 is removably attached to the front surface 66 of the card shoe body 62 allowing for easy removal. For example, the faceplate 68 can he snap fitted onto the card shoe body 62 using an annular or cantilever snap fit mechanism, The front cover plate 90 is then positioned on and attached to the front surface 66 of the card shoe body 62, with the first end 92 being positioned adjacent of an upper portion of the front face 66 and the second end 94 being position to a lower portion of the front face 66. The front cover plate 90 is removably attached to front surface 66 of the card shoe body 62 allowing for easy installation and removal. For example, the faceplate 68 can be snap fitted onto the card shoe body 62 using an annular or cantilever snap fit mechanism. Upon installation of the front cover plate 90 on the card shoe body 62, the locking mechanism 98 is actuated, rotating the lever arm 102 to engage the cards shoe body 62, locking the front cover plate 90 to the card shoe body 62.

As the front cover plate 76 has a solid front surface 82 the front cover plate 76 prevents access to the play cards through the front surface 66 of the cards shoe body 62.

To configure the card shoe 60 for game play the front cover plate 90 is unlocked from and is removed from the card shoe body 62. The face plate 68 is then positioned on and attached to the front surface 66 of the card shoe body 62. The reinstallation of the faceplate 68 on the card shoe body 62 allows playing cards to be freely drawn from the mouth 65 of the card shoe 60.

Referring to FIG. 17, there provided a faceplate insert 110. The faceplate insert 110 includes first and second ends 112 and 114, and has a solid front surface 116. The faceplate insert 110 is sized and configured to fit into the inverted V-shaped or U-shaped opening 70 of the faceplate 68.

Referring to FIG. 18, to secure the card shoe 60 the faceplate insert 110 is installed in the opening 70 of the faceplate 68, with the first end 112 being positioned adjacent of an upper portion of the opening 70 and the second end 114 being position to a lower portion of the front face 66. The faceplate insert 110 is removably attached to the faceplate 68 allowing for easy removal. For example, the faceplate insert 110 can he snap fitted onto the faceplate 68 using an annular or cantilever snap fit mechanism. As the faceplate insert 110 has a solid front surface 116 the faceplate insert 110 prevents access to the play cards through the mouth 64 of the faceplate 68.

To configure the card shoe 60 for game play the faceplate insert 110 is removed from the faceplate 68. The removal of the faceplate insert 110 from the faceplate 68 allows playing cards to be freely drawn from the mouth 64 of the card shoe 60, Referring to FIG, 19, there provided a faceplate insert 120. The faceplate insert 120 includes first and second ends 122 and 124, and has a solid front surface 126. The faceplate insert 120 is sized and configured to fit into the inverted V-shaped or U-shaped opening 70 of the faceplate 68. The faceplate insert 120 further includes a locking mechanism 128 having a mechanical actuator 130 and a lever arm 132, where an activation of the actuator 130 will rotate the lever arm 132 from an unlocked position to a locked position, and a locked position to an unlocked position. In an example, the actuator 130 is depicted as a depression switch, the pushing of which will rotate the lever arm 132 from an unlocked position to a locked position, and a locked position to an unlocked position. However, other mechanical actuators 130 are contemplated, including key system, rotatable actuator and the like.

Referring to FIG. 20, to secure the card shoe 60 the faceplate insert 120 is installed in the opening 70 of the faceplate 68, with the first end 122 being positioned adjacent of an upper portion of the opening 70 and the second end 124 being position to a lower portion of the front face 66. The faceplate insert 12.0 is removably attached to the faceplate 68 allowing for easy removal. For example, the faceplate insert 12.0 can be snap fitted onto the faceplate 68 using an annular or cantilever snap fit mechanism.

Upon installation of the faceplate insert 120 on the faceplate 68, the locking mechanism 128 is actuated, rotating the lever arm 132 to engage the faceplate 68, locking the faceplate insert 120 to the faceplate 68 and card shoe body 62. As the faceplate insert 120 has a solid :front surface 126 the faceplate insert 120 prevents access to the play cards through the mouth 64 of the faceplate 68.

To configure the card shoe 60 for game play the faceplate insert 120 is unlocked and removed from the faceplate 68. The removal of the faceplate insert 120 from the faceplate 68 allows playing cards to be freely drawn from the mouth 64 of the card shoe 60.

It is also contemplated that the above card shoes can include an internal alarm, the actuation if which is caused by an improper removal of the card shoe protection system.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A playing card shoe, comprising:

an elongated body having a card cradle for supporting a plurality of playing cards, the card cradle having an outlet opening adjacent to a front end of the elongated body;

a cradle cover removably attachable to the elongated body, covering the card cradle;

a faceplate removably attachable to an outer surface at the front end of the elongated body, and defining a mouth through which playing cards can be drawn from the outlet opening; and a means for blocking the outlet opening preventing the removal of any playing cards comprising a card shield having a first end and a second end, the card shield being removeably positionable in the card cradle such that a portion of the card shield is positioned over the playing card with the first end positioned between the playing cards and the outlet opening, at least a portion of the first end extending through the outlet opening.

2. A playing card shoe as set forth in claim 1, the means for blocking the outlet opening further comprising a retaining member affixed to an underside surface of the cradle cover, the retaining member engaging at least a portion of the card shield.

3. A playing card shoe as set forth in claim 2, the means for blocking the outlet opening comprising a cut card removeably positionable between the playing cards and the outlet opening, wherein the first end of the card shield is positioned between the cut card and the outlet opening, at least a portion of the first end extending through the outlet opening.

4. A playing card shoe as set forth in claim 3, wherein the retaining member is a magnet.

5. A playing card shoe as set forth in claim 4, wherein the cards shield is made of a magnetic material.

6. A security apparatus for use on a playing cards shoe having an elongated body including a card cradle for supporting a plurality of playing cards, the card cradle having an outlet opening adjacent to a front end of the elongated body, a cradle cover removably attachable to the elongated body, covering the card cradle, a faceplate removably attachable to an outer surface of the front end of the elongated body, and defining a mouth through which playing cards can be drawn from the outlet opening, comprising:

a blocking means comprising a face plate insert having a solid top surface, the face plate insert being removably attachable into the mouth of the face plate, covering the outlet opening to prevent the removal of any playing cards from the outlet opening.

7. A security apparatus as set forth in claim 6, the front cover comprising a locking mechanism including a mechanical actuator.

* * * * *